US010669796B2

(12) United States Patent
Saltykov et al.

(10) Patent No.: US 10,669,796 B2
(45) Date of Patent: Jun. 2, 2020

(54) METHOD FOR ULTRASOUND STIMULATION OF OIL PRODUCTION AND DEVICE FOR IMPLEMENTING SAID METHOD

(71) Applicant: ILMASONIC-SCIENCE LIMITED LIABILITY COMPANY, Moscow (RU)

(72) Inventors: Alexandr Alexeevich Saltykov, Schelkovo (RU); Yuriy Alexeevich Saltykov, Moscow (RU)

(73) Assignee: ILMASONIC-SCIENCE LIMITED LIABILITY COMPANY, Moscow (RU)

( * ) Notice: Subject to any disclaimer, the term of this patent is extended or adjusted under 35 U.S.C. 154(b) by 0 days.

(21) Appl. No.: 16/320,099

(22) PCT Filed: Aug. 18, 2017

(86) PCT No.: PCT/RU2017/050076
§ 371 (c)(1),
(2) Date: Jan. 24, 2019

(87) PCT Pub. No.: WO2018/021949
PCT Pub. Date: Feb. 1, 2018

(65) Prior Publication Data

US 2019/0271202 A1 Sep. 5, 2019

(30) Foreign Application Priority Data

Jul. 26, 2016 (RU) ..... 2016130667

(51) Int. Cl.
*E21B 28/00* (2006.01)
*E21B 43/00* (2006.01)
(Continued)

(52) U.S. Cl.
CPC ..... *E21B 28/00* (2013.01); *E21B 43/003* (2013.01); *E21B 43/25* (2013.01); *E21B 43/16* (2013.01)

(58) Field of Classification Search
CPC ..... E21B 28/00; E21B 43/003; E21B 43/16
See application file for complete search history.

(56) References Cited

U.S. PATENT DOCUMENTS

2005/0115716 A1* 6/2005 Ciglenec ..... E21B 49/081 166/373
2009/0200019 A1 8/2009 DeLaCroix et al.
2017/0175505 A1* 6/2017 Curlett ..... E21B 43/2401

FOREIGN PATENT DOCUMENTS

RU 2162519 C1 1/2001
RU 2215126 C1 10/2003
(Continued)

OTHER PUBLICATIONS

Translated Iper from PCT/RU2017/050076. (Year: 2017).*

*Primary Examiner* — Zakiya W Bates
(74) *Attorney, Agent, or Firm* — Dmitry S. Kryndushkin

(57) ABSTRACT

The method for stimulation of oil production involves the positioning of a downhole device at the operational depth of a well, the device being connected to a surface supply, and the excitation of elastic oscillations of certain distinct frequencies. Furthermore, bottom-hole clogging products are crushed and formation oil recovery is stimulated by a periodic impact on the bottom-hole zone of an ultrasound-range elastic oscillation field in a continuous mode and in a low-frequency pulse mode with simultaneous removal of clogging materials from the bottom-hole oil formation zone. In the continuous mode, the impact is carried out using a high-frequency oscillation of 16-25 kHz, and in the pulse mode, the impact is carried out at a frequency of 1-50 Hz. In terms of their design, the devices for stimulation of oil
(Continued)

production consist of the following principal items of equipment: an ultrasound generator, a downhole ultrasonic emitter, a jet pump and a geophysical cable.

13 Claims, 3 Drawing Sheets

(51) Int. Cl.
*E21B 43/16* (2006.01)
*E21B 43/25* (2006.01)

(56) References Cited

FOREIGN PATENT DOCUMENTS

| | | |
|---|---|---|
| RU | 2392422 C1 | 6/2010 |
| RU | 2511167 C1 | 4/2014 |

* cited by examiner

METHOD FOR ULTRASOUND STIMULATION OF OIL PRODUCTION AND DEVICE FOR IMPLEMENTING SAID METHOD

TECHNICAL FIELD OF THE INVENTION

The invention relates generally to the field of oil production. More specifically, the present invention relates to the method of oil production stimulation and enhancing oil recovery. The present method is mostly applicable for old oil fields with a low reservoir pressure, marginal wells and heavily clogged wells.

BACKGROUND OF THE INVENTION

Regulatory documents on the subject of oil-and-gas well operation safety require to conduct all wellbore operations through tubing assembly. The most common tubings are 60-89 mm in diameter, therefore downhole devices used in a bottom-hole formation zone must have maximum diameters of 44-52 mm.

The known method [1] is based on the excitation of a downhole ultrasonic emitter by an electric signal within a process frequency range, the energy conversion of an electric signal into acoustic vibrations energy. A near productive zone of a well is affected by acoustic vibrations of the sum of electric signals of frequency series within a process frequency range. A distant productive zone is affected by low-frequency acoustic vibrations of combinative residual frequencies within a process range. The device comprises series-connected: control device comprised of a multi-channel master frequency oscillator and a multi-channel phase-pulse modulator; generating device including a number of power amplifiers; coordinator; cable; downhole ultrasonic emitter; power rectifier.

While applying this method for a treatment of a productive well zone in a perforated interval, a treatment increment is 1-2 meters, a downhole ultrasonic emitter with the active length of 0.5-1.5 meters and the acoustic power of 0.5-5 kW, wherein at each increment a downhole ultrasonic emitter at first is excited by a tonal frequency-modulated signal during 0.1-1 hour and then is excited by an electric signal in the form of the sum of electric signals of frequency series within a process frequency range, including frequency-modulated ones, during 1-4 hours. Frequencies within a process range are set in the range of 10-60 kHz, taking into account geological characteristics of a near productive well zone, so that combinative difference frequencies fall in the range of 20-4000 Hz taking into account geology of a distant productive well zone.

Noting the appropriateness of the aim—to ensure efficiency of an impact on an oil formation for improving a production rate of a well due to the influence of high-frequency and low-frequency vibrations, it should be noted that the authors do not fully understand the physics and the objectives of an impact on a bottom-hole formation zone by various frequencies. An impact of high-frequency vibrations (16-30 kHz) provides a clearance of perforation tunnels and a bottom-hole zone of colmatant and other types of clogging. Away back in the 1970s, it was experimentally proved that the most effective frequencies for this task are the frequencies close to 20 kHz [2, 3]. Low-frequency vibrations [3, 4] are intended precisely to enhance oil recovery of a formation by the initiation of filtration flows in a reservoir in general. The greatest impact is reached when properties of low-frequency vibrations are close to properties of resonating vibrations of an oil formation [4].

The detailed description of the control device producing specified output signals is given but there is almost no operation description of the downhole ultrasonic emitter. Meanwhile, the proposed equipment must be considered as a unified system providing the furtherance of the desired objective. Signals formed in the output of the control device are different from acoustic emitter output signals in means of frequency and power. In the downhole emitter there is a piezoceramic transducer converting electric signals into mechanical signals. For such emitters the piezoceramics with high Q-factor is used in order to get the maximal vibrations amplitude (intensity of the radiation) at a resonating frequency [5]. However, with higher Q-factor of piezoceramics the range of resonating frequency is narrower (FIG. 1). In the invention it is also proposed to set a wide process range of frequencies 10-60 kHz. It means that the emitter would have the maximal power level (intensity of the radiation) only on one specified frequency, but on other frequencies the efficiency would be close to zero. Let us explain it by an example. The intensity of radiation drops sharply in passing through the interface of two mediums. The known dependence is [6]:

$$I_2=I_1(4c_1p_1/c_2p_2)/\{c_1p_1/c_2p_2+1\}^2, \text{ where}$$

$I_1$, $I_2$—are the intensities of radiation of the first and the second mediums, $c_1$, $c_2$—sound velocity in medium 1 and medium 2, respectively, $p_1$, $p_2$—density of medium 1 and medium 2, respectively.

After we substitute the values of the two mediums—oil and steel (well casing), we can see that the intensity of radiation just by so doing would be decreased more than 3 times.

It is also stated in the description that the emitter comprises several piezoceramic packages. Meanwhile, the control device does not provide the use of an automatic frequency maintaining system to provide the simultaneous operation in the mode maximally close to resonating one.

The above-mentioned method does not provide a pressure drawdown in a perforation zone and elimination of clogging materials from a well and bottom-hole formation zone. However, acoustic technologies experience of numerous oilfield service companies [2, 3] and the experience of the authors of the invention shows that deployment of this technology significantly increases (2-3 times) the duration of the acoustic treatment effect because broken physico-chemical bonds of clogging materials recover again and clog a bottom-hole zone and perforation tunnels.

There is also a method [7] of recovery and maintaining productivity of a well including an acoustic impact on a well and formation implemented cyclically, in the presence of a pressure gradient between well and formation, with the beginning of a cycle at maximum pressure differential between well and formation in the time of declining of well production rate or well intake capacity and the end of a cycle while achieving the stabilization in the increase of well production rate/intake capacity or stopping the flow between well and formation.

The pressure gradient is produced by a high-productivity pump installed at the deepest possible depth and operated in the mode of producing alternating pressure drawdowns, once maximally pumping out all the fluid from a well and producing a maximal pressure drawdown, once halting for fluid accumulation, wherein the formation is loaded with considerable and alternating pressure drawdowns with simultaneous acoustic impact or in the presence of the flowing effect the natural pressure gradient between a well and formation is used.

An impact is applied by an acoustic emitter plunged into a well simultaneously with downhole equipment during well development or workover process before running a well, an acoustic emitter is installed in a perforated formation zone or a selected medium with a possibility of influencing on a productive (perforated) formation zone, by means of, for example, choosing the appropriate length of an emitter or number of series-connected emitters.

A drawback of this method is that a downhole emitter is installed at one fixed point in a well. In case of a large thickness of a formation or a large number of mediums only the zone near the emitter would be treated and other zones would not be. A pressure drawdown and continuous fluid removal from a well enable to remove degradation products of clogging materials in time and increase the lifetime of the effect. However, the use of a high-productivity pump operated in the mode of producing alternating pressure drawdowns in a bottom-hole zone increase the cost of oil production and risks of expensive downhole equipment failure. In the description of the method it is stated that there is some pulse mode of the emitter but there is no description of how it is carried out. There is also no description of the operation modes (frequency, intensity, time, etc.), which makes it impossible to compare the inventions fully.

There is also a known method similar to the invention in operational principles and taken by the claimants as a prototype [8]. The method includes the installation of a downhole device in a well at the operational depth connected to a surface industrial frequency power supply and comprising an ultrasonic transducer providing elastic vibrations of high frequency, an excitation of elastic vibrations of various frequencies and subsequent repeated impact by elastic vibrations on an oil formation. This impact is carried out by high and/or low frequency vibrations.

To generate elastic vibrations of high and low frequency there are used two independent sources of vibration, one of which is at least one emitting ultrasonic, mostly magnetostrictive, transducer and the second one is based on an electropulse device, which provides generation of low frequency elastic vibrations, connected to a surface industrial frequency power supply and comprises electrically interconnected: a charging unit, a unit of storage capacitors, a discharge unit provided with electrodes, two switching units, one of which configures separate storage capacitors into one single unit and the second one provides switching of storage capacitors to other type of connection. Meanwhile, the impact of high-frequency elastic vibrations is carried out within a low-frequency ultrasound range, mostly at the frequency of 18-44 kHz, and the impact is conducted in the continuous and/or the pulse mode within the intensity of 1-5 $W/cm^2$. The impact of low-frequency elastic vibrations is carried out with the pulse discharge frequency of 0.2-0.01 Hz and the impact is conducted with the energy of single discharge pulse which is 100-800 J.

It is proposed to use a magnetostrictive device as an ultrasonic emitter. Such a device has only one emitting point—in the center of a waveguide, whence the acoustic waves approximate in shape to the ellipsoid shape are emitted into space. The primary emission goes in the radial direction. Thus, in a fixed state it only treats a narrow strip of bottom-hole zone. To provide an effective bottom-hole formation zone cleaning, especially perforation zone of a well, it must be moved along a well in very short increments of 0.2-0.3 m, which increase the time of treatment significantly.

It is proposed to use an electrohydraulic device with the diameter of 106 mm as a low frequency emitter. Such a device can only be used only in a casing pipe, therefore, to provide safety, the authors propose to use the method in which both devices are attached to the tubing and are lifted down to the treatment zone. Thus, such a configuration can only treat a zone with the width of 2-3 meters, and the other formation zones will remain untreated.

In the considered method the use of pressure drawdown is stipulated (by means of a pump or a swab), as well as the fluid removal with broken clogging materials from the bottom-hole zone. However, the aforementioned drawback will not bring any significant effect, especially in wells with centrifugal pumps.

SUMMARY OF THE INVENTION

The technical result consists in efficiency improvement, success in stimulation of oil production and effect longevity after a treatment by equipment in use.

Efficiency is the incremental oil rate of a well.

Success in stimulation of oil production is the increase of well flowrate as the result of bottom-hole zone treatment.

Effect longevity is the lifetime of incremental oil rate in respect to initial value.

The claimed technical result is provided through stimulation of oil production including installment of a downhole device in a well at the operational depth connected to a surface supply, excitement of elastic vibration of various frequencies, wherein bottom-hole clogging products are crushed and formation oil recovery is stimulated through recurring impact on a bottom-hole zone by an oscillatory field of elastic vibrations within ultrasonic range in continuous mode and by low-frequency pulse acoustic impact with simultaneous removal of clogging materials from bottom-hole oil formation zone through creation of rarefaction space in the perforation zone of a well and leaching clogging materials out of a well by a jet pump, in continuous mode the impact is produced by high-frequency vibration within ultrasonic range of 16-25 kHz, in pulse mode the impact is produced within the frequency of 1-50 Hz, implementation of the impact on the perforation zone starts from the bottom part with subsequent moving up.

In a specific case of implementation of the claimed technical solution the process of clogging materials crushing and oil recovery stimulation is provided by an emitter of piezoceramic type.

In a specific case of implementation of the claimed technical solution the process of clogging materials crushing and oil recovery stimulation is provided by an emitter of magnetostrictive type.

In a specific case of implementation of the claimed technical solution the treatment can be implemented relying on time of treatment, during 60 minutes with periodic switch after 10 minutes from continuous mode to the pulse mode.

In a specific case the alternating, continuous (in the range of 16-25 kHz) and pulse (with a frequency of 1-50 Hz) modes of treatment can be used for heavy and high-viscosity oils production increase.

In a specific case of implementation of the claimed technical solution an ultrasonic emitter is run in the hole together with a geophysical device which provides the data for choosing the mode of bottom-hole zone treatment.

The claimed technical result is also provided through an ultrasonic oil production stimulation device comprising an ultrasonic generator, a cable, a downhole ultrasonic emitter, wherein additionally comprising a surface high-pressure pumping unit and a fill-up unit containing liquid, wherein the surface high-pressure pumping unit is connected by high-pressure supply pipes to a tubing string through a bolt with a non-return valve, the fill-up unit containing liquid is connected by a drain line hose to an intake pipe of the pumping unit and the intake pipe is connected to a casing valve, wherein inside a process tubing a jet pump is additionally installed, whereby the jet pump comprising an axial hole for the downhole emitter passage, the axial hole is hermetically sealed by an insert which enables a geophysical cable to move freely, the downhole ultrasonic emitter has a modular design and is comprised of resonators with piezoelectric packages.

In a specific case of implementation of the claimed technical solution a downhole ultrasonic emitter is made with the diameter of 44 mm.

In a specific case of implementation of the claimed technical solution a downhole ultrasonic emitter is made with the diameter of 52 mm.

In a specific case of implementation of the claimed technical solution a downhole ultrasonic emitter is connected to a geophysical device which is connected to a log recorder by means of a geophysical cable.

In a specific case of implementation of the claimed technical solution a downhole ultrasonic emitter is made with the length of 1.0-2.0 meters.

In a specific case of implementation of the claimed technical solution a downhole ultrasonic emitter is of piezoceramic type.

In a specific case of implementation of the claimed technical solution a downhole ultrasonic emitter is of magnetostrictive type.

In a specific case of implementation of the claimed technical solution a downhole ultrasonic emitter resonator provides the intensity of radiation of 3 $W/cm^2$.

A complex impact method on the perforation zone and bottom-hole formation zone. An impact is primarily provided through high-frequency vibrations within the ultrasonic range (16-25 kHz) in continuous mode. This frequency range is the most effective one for clogging materials crushing in perforation tunnels and a bottom-hole zone. For the effective cleaning the intensity of influencing emission must be no less than 0.2 $W/cm^2$. For this reason, taking into consideration losses in a well and a formation, the device with the surface radiation intensity of minimum 3 $W/cm^2$ was developed.

The calculations made using aforementioned formula show that it will allow to effectively treat the bottom-hole zone at a distance up to 1.0-1.5 m, i.e. the most damaged zone.

Secondly, the present emitter will work with the same intensity in the pulse mode with the frequency of 1-50 Hz. Such frequencies provide the effective initiation of filtration flows in a formation.

Particular treatment frequencies and time of treatment using a particular frequency will be chosen basing on processed geological, geophysical, hydrodynamic information about a well and a parameters history collected during wells operation on particular oil and gas field. For example, in the FIG. 2 there is shown the dependence of acoustic field transmission coefficient |K| on the frequency ω for various formations [2]. Transmission coefficient determines the quantity of elastic energy penetrated through the layer relative to the energy of radiation in one infinite medium. The schedule shows the influence of various formations on the penetration of radiation energy in conditions of similar frequency, or the way to attain similar radiation energy while penetrating through different formations by means of changing frequency.

A jet pump is used to remove crushed clogging materials. It allows to create a pressure drawdown in the treatment zone, thereby to remove the materials from a well. Clogging materials crushed by ultrasound have a way of recovering in 8-12 hours, therefore with the better cleaning of a well and its bottom-hole zone comes longer effect and higher production increase. To this must be added that with the operation of a jet pump simultaneously occurs the development of a well, i.e. inflow stimulation from a formation in complex with low-frequency impact provide enhanced oil recovery. Inflow stimulation is a very important factor, especially for old fields, low-pressure fields and marginal wells.

The authors of present invention have tested various methods of pressure drawdown generation when using ultrasonic equipment—nitrogen system, jet pump, swabbing, etc. Nevertheless, with regard to the "efficiency—cost" parameter a jet pump was chosen.

BRIEF DESCRIPTION OF THE DRAWINGS

Details, features and advantages of the present useful model result from the following description of ways to realize the claimed technical solution using the drawings showing:

In the figures the parts are marked by numerals as follows: 1—productive formation, 2—geophysical device, 3—downhole acoustic device, 4—funnel, 5—packer, 6—jet pump, 7—sealing insert, 8—tubing, 9—casing valve, 10—tubing adapter, 11—bolt with a non-return valve, 12—wellhead stuffing box, 13—suspension unit, 14—geophysical cable, 15—ultrasonic generator in a logging truck, 16—logging truck, 17—high-pressure pumping unit, 18—fill-up unit (tank truck), 19—piezoelectric package, 20—housing, 21—molding, 22—limestone, 23—sandstone, 24—clay, 25—water-saturated sand, 26—resonator.

DISCLOSURE OF THE INVENTION

The equipment for stimulation of oil production is structurally represented by three basic devices: ultrasonic generator (15), downhole acoustic device (2) and jet pump (6).

Ultrasonic generator (15) comprising: a control board, an LCD screen to display values of set and current parameters, a power unit, control and equipment diagnostics masters, a resonating frequency forming module, a pulse signals forming module, an output transformer unit, an automatic preset voltage maintaining module. The generator has a galvanic isolation of 3 kW between the output voltage circuit, the control circuit and the 220V power supply.

The power unit supplies the electric power at the industrial frequency and a voltage of 220V to all the units and modules of generator (15). The output transformer unit provides an output voltage to the acoustic emitter of 300-1500 V. This voltage range is required for operation at various production fields with various geophysical cables of different lengths and configurations (1, 2, 3, and 7-conductor cables), having different resistance to overcome which a high voltage is required.

The resonating frequency forming module provides fast and automatic resonating frequency search in increments of 1 Hz with feedback on consumption current with allowance for a large number of piezoceramic packages and maintains it in the automatic mode.

The characteristics of piezoceramic packages, including a resonating frequency, depend on external impact, therefore the automatic resonating frequency maintaining guarantees the most effective performance of the emitter in particular conditions.

The pulse signals forming module forms signals with the highest voltage and resonating frequency and sends these pulses to the downhole emitter. The modules are operated alternately by time. Their operation periodicity is set by an operator and is maintained automatically by a controller.

Figure 1:
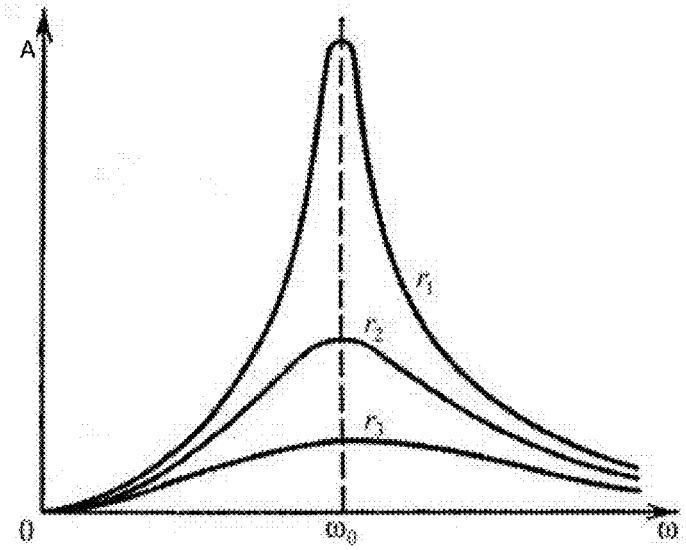
FIG. 1—the dependence diagram of amplitude value and resonating frequencies range on piezoceramics Q-factor.
Figure 2:
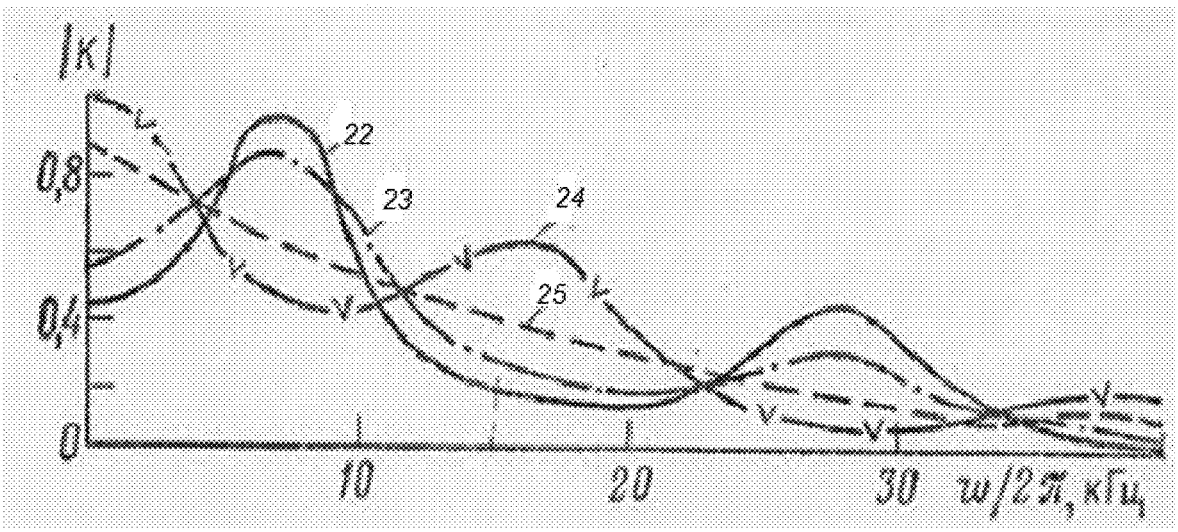
FIG. 2—the dependence diagram of transmission coefficient |K| on the frequency ω for various formations.
Figure 3:
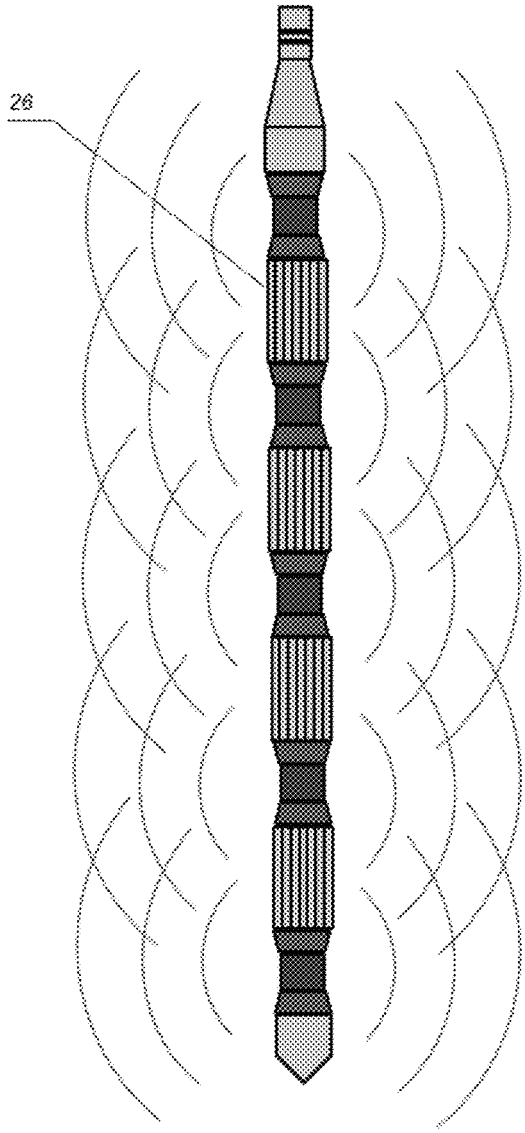
FIG. 3—the downhole acoustic device diagram.

The downhole acoustic device has a modular design (FIG. 3). It is comprised of separate resonators with piezoelectric packages. Magnetostrictive transducers can be used instead of piezoelectric packages. There is a pairing head for connection to a cable head at one end of the emitter, a guiding head of conical shape at the other end. By varying the number of resonators, the emitter can be made of a length 1.0-2.0 meters. Such design allows to create a uniform radiation field along the entire length of the device. Every resonator provides the radiation intensity of 3 W/cm$^2$. The emitter consumes the voltage up to 800 V.

The emitters are made in the diameters of 44 and 52 mm. Depending on the length and diameter their consuming power can be 1-4 kW.

Figure 4:
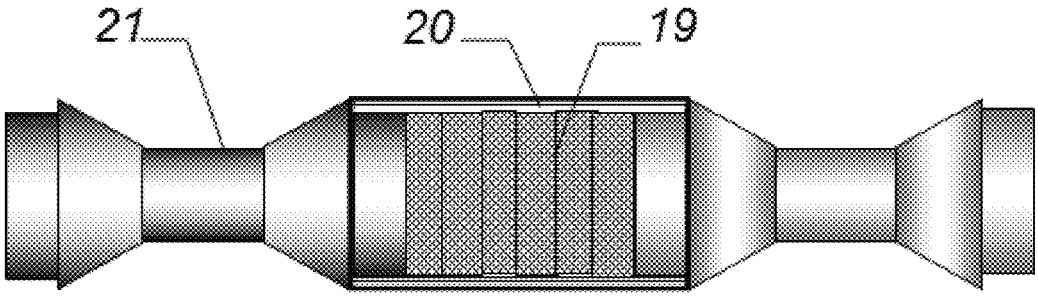
FIG. 4—the design of the acoustic resonator.

In FIG. 4 there is the outlinear drawing of the resonator design. It is comprised of a housing for placement of piezoceramic packages and moldings which grip the piezoceramic package in the housing. The moldings also provide interconnection of piezoceramic packages, thereby forming the modular design of the emitter. There are axial holes in moldings and piezoceramic packages through which electric wires pass. All the internal voids of the resonator are filled with special HTSR paste which serves both as an electric insulator and as a heat sink.

Since the diameter of the emitter is small, the piezoceramic package is placed along its axis. Piezoelectric elements (which the piezoceramic package consists of) radiate, depending on the material used, up to 80% of energy in axial direction and up to 20% in radial direction. In order to provide high efficiency of the emitter, radiation energy must be directed most in the radial direction and least in the axial direction. For reorientation of the axial radiation of the piezoceramic package in the radial one, the bevels are made on the moldings. In order to maximize the use of the energy of the radial radiation of piezoceramic package, on the housing longitudinal grooves which increase transverse response of the housing are made.

The design of the resonators is formed so that at the resonating frequency of piezoceramic packages, the resonators radiate acoustic waves with the frequency about 20 kHz.

Instead of piezoceramic transducers of electric energy into ultrasonic vibrations, magnetostrictive transducers can be used. Since it also must be placed along the axis and most energy will be radiated in the axial direction, all the design solutions for reorientation of the axial radiation in the radial one will also be relevant.

In the present method a jet pump is used which includes an axial hole for the downhole emitter passage. The hole is hermetically sealed by an insert which enables a geophysical cable to move freely. The holes can be of 52 and 60 mm in diameter. It is required in order to apply emitters of various diameters while using various tubings with different diameters in a well.

Figure 5:
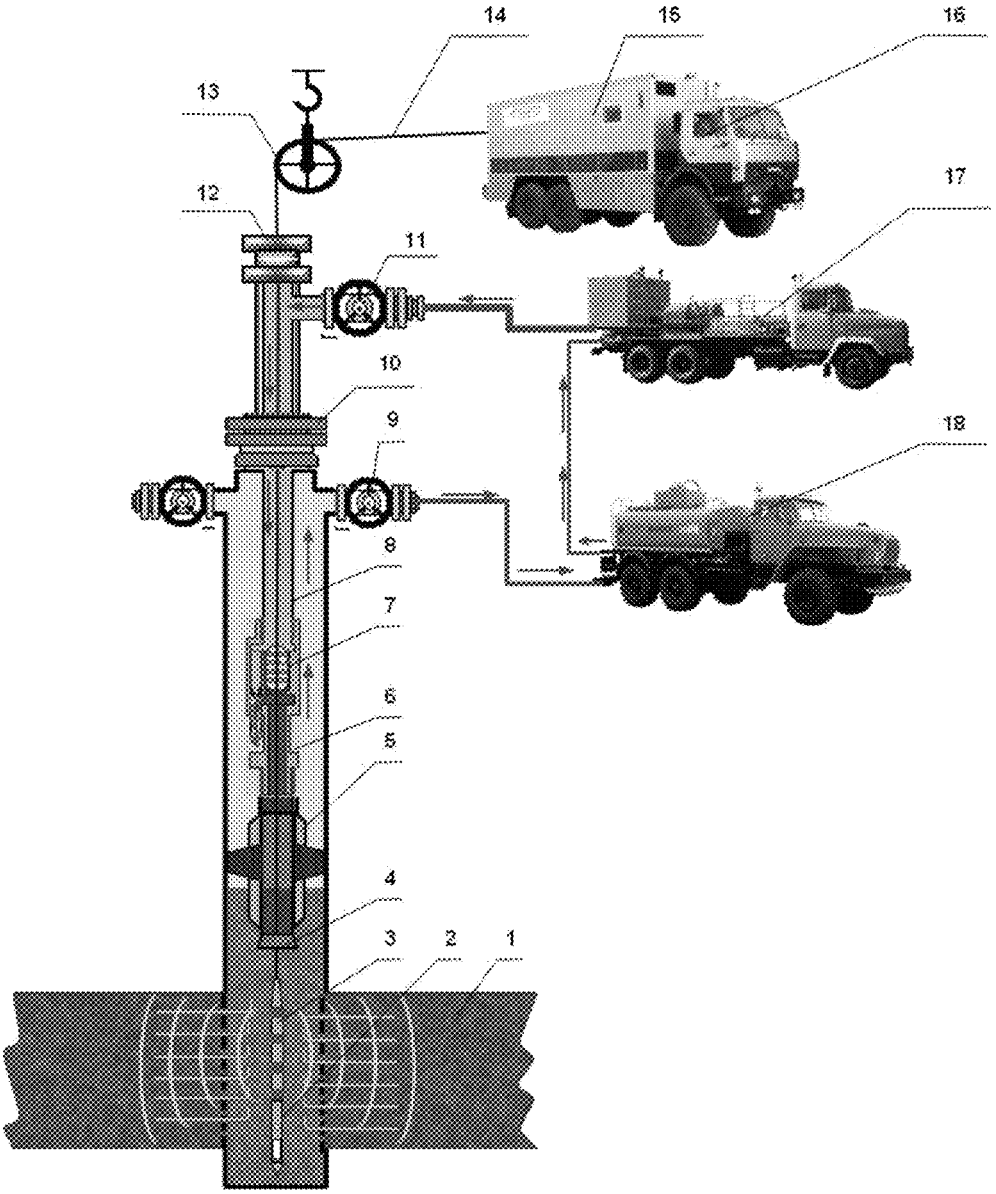
FIG. 5—the layout drawing of the equipment and rigs for implementation of the present oil production stimulation method.

The method of oil production stimulation supposes the following operation of the devices in use (FIG. 5).

Process tubing (8) is lowered into the well with built-in jet pump (6), packer (5) is installed below the jet pump. Supplemental rigs are arranged (pumping unit ⊔A-320 and fill-up unit A⊔-10) according to the established regulations. Pumping unit (17) is connected by high-pressure supply pipes to the tubing through a bolt with non-return valve (11). The fill-up unit containing liquid is connected by drain line hoses to the intake pipe of pumping unit (17) and the intake pipe is connected to casing valve (9). Ultrasonic generator (15) placed in geophysical rig (16) is connected to geophysical cable (14). Idlers (13) are suspended to geophysical rig (16), geophysical cable (14) is pulled. Downhole ultrasonic emitter (2) is connected to the geophysical cable and lowered into the well through wellhead stuffing box (12) and jet pump (6) to the bottom edge of the perforation zone. The geophysical cable in the jet pump is hermetically sealed by insert (7). By means of pumping unit (17) operating fluid (process water) is fed to the jet pump through the tubing. Operating fluid is circulated through the jet pump and fluid is pumped out of the zone under the parker to fill-up (18). Pressure drawdown is provided in the zone under the parker.

Ultrasonic generator (15) is turned on and after internal diagnostics provides voltage to the downhole emitter. The resonating frequency is determined in the ultrasonic generator, then the treatment of the perforation zone by ultrasonic waves starts. The treatment is implemented consistently in the continuous and pulse modes with the period set by an operator.

The drawdown pressure provides the removal of crushed colmatant from the well and the bottom-hole formation zone (1) and then it is pumped to the fill-up unit by the jet pump. There simultaneously occurs the development of the well through the inflow stimulation from a formation.

The perforation zone treatment starts from the bottom interval and lasts for about 1 hour, then the emitter is lifted up at a distance of its length. The treatment of all the perforation and bottom-hole zone is implemented in this way. The water flooding zones are determined according to initial geophysical data and excluded from the treatment. It provides the limitation of water inflow.

The bottom-hole zone treatment can be implemented on the basis of the formation characteristics and the well history as well as objective measures of geophysical device (2), which is fixed to the ultrasonic emitter. The geophysical downhole device is intended for fixation to the perforation zone and treatment process control of the bottom-hole formation zone in order to adjust the treatment modes in real time, which significantly increases the percentage of successful operations. During the treatment the geophysical device is used to control pressure, temperature, humidity and inflow. On the basis of these measures the time and treatment modes are adjusted in a given perforation zone interval.

After the treatment is completed, the jet pump stops (the pumping unit is turned off) and excess tubing pressure is released, downhole devices are lifted from the well and they are disconnected from the geophysical cable. The pumping unit and fill-up unit are turned off, the wellhead stuffing box is dismantled. All the special equipment and devices are disconnected from process connectors and switched into the transit position.

The example of specific realization of the present method does not exclude other variants of its execution within the claims. Specifically, the alternating, continuous (in the range of 16-25 kHz) and pulse (at a frequency of 1-50 Hz) modes of treatment can be used for heavy and high-viscosity oils production increase. In so doing, the ultrasonic emitter and the geophysical device can be permanently installed in the well.

REFERENCES

1. Патент No RU2162519, Способ акустической обработки продуктивной зоны скважины и устройство для его реализации, 2001 г.
2. Кузнецов О. Л., Ефимова С. А. Применение ультразвука в нефтяной промышленности.-М: Недра, 1983, 193 с.
3. Кузнецов О. Л., Симкин Э. М., Чилингар Дж. Физические основы вибрационного и акустического воздействия на нефтегазовые пласты, 2001, 260с.
4. Кузнецов О. Л., Чиркин И.А., Курьянов Ю. А. и др. Сейсмоакустика пористых и трещиноватых геологических сред, 2007, 432 с.
5. Кикучи Е. Ультразвуковые преобразователи, 1972, 424 с.
6. Агранат Б. А., Дубровин М. Н., Хавский Н. Н., Эскин Г.И. Основы физики и техники ультразвука, 1987, 352 с.
7. Патент No RU2215126, Способ восстановления и поддержания продуктивности скважины, 2002 г.
8. Патент No RU2392422, Способ добычи нефти с использованием энергии упругих колебаний и установка для его осуществления, 2009 г.

The invention claimed is:

1. A method of stimulation of oil production, comprising installment of a downhole device in a well at an operational depth connected to a surface supply, and excitement of elastic vibrations of certain distinct frequencies, characterized in that bottom-hole clogging products are crushed and formation oil recovery is stimulated through a recurring impact on a bottom-hole zone by an oscillatory field of elastic vibrations within ultrasonic range in a continuous mode and in a low-frequency pulse mode with simultaneous removal of clogging materials from the bottom-hole zone through creation of a rarefaction space in the bottom-hole zone of the well and leaching clogging materials out of the well by a jet pump, wherein in the continuous mode the impact is produced by high-frequency vibration within ultrasonic range of 16-25 kHz, and in the low-frequency pulse mode the impact is produced within the frequency of 1-50 Hz, wherein implementation of the impact on the bottom-hole zone starts from a bottom part with subsequent moving up.

2. The method according to claim 1, characterized in that the process of clogging materials crushing and oil recovery stimulation is provided by an emitter of a piezoceramic type.

3. The method according to claim 1, characterized in that the process of clogging materials crushing and oil recovery stimulation is provided by an emitter of a magnetostrictive type.

4. The method according to claim 1, characterized in that the recurring impact is implemented relying on time of the impact, with total duration of 60 minutes and with periodic switches after each 10 minutes from the continuous mode to the pulse mode, and back.

5. The method according to claim 1, characterized in that an ultrasonic emitter is lowered into the well together with a geophysical device which provides data for choosing the mode of the impact on the bottom-hole zone.

6. An ultrasonic oil production stimulation device, comprising an ultrasonic generator, a geophysical cable, a downhole ultrasonic emitter, characterized in that the device additionally comprises a surface high-pressure pumping unit and a fill-up unit containing liquid, wherein the surface high-pressure pumping unit is connected by high-pressure supply pipes to a tubing string through a bolt with a non-return valve, the fill-up unit containing liquid is connected by drain line hoses to an intake pipe of the pumping unit and the intake pipe is connected to a casing valve, wherein inside the tubing string a jet pump is additionally installed, whereby the jet pump comprising an axial hole for passage of the downhole ultrasonic emitter, the axial hole is hermetically sealed by an insert which enables the geophysical cable to move freely, the downhole ultrasonic emitter has a modular design and is comprised of resonators with piezoelectric packages.

7. The device according to claim 6, characterized in that the downhole ultrasonic emitter is made with the diameter of 44 mm.

8. The device according to claim 6, characterized in that the downhole ultrasonic emitter is made with the diameter of 52 mm.

9. The device according to claim 6, characterized in that the downhole ultrasonic emitter is connected to a geophysical device which is connected to a log recorder by means of a geophysical cable.

10. The device according to claim 6, characterized in that the downhole ultrasonic emitter is made with the length of 1.0-2.0 meters.

11. The device according to claim 6, characterized in that the downhole ultrasonic emitter is of piezoceramic type.

12. The device according to claim 6, characterized in that the downhole ultrasonic emitter is of magnetostrictive type.

13. The device according to claim 6, characterized in that each of the resonators of the downhole ultrasonic emitter provides the intensity of radiation of 3 $W/cm^2$.

* * * * *